US005211815A

United States Patent [19]

Ramasubramanian et al.

[11] Patent Number: 5,211,815

[45] Date of Patent: May 18, 1993

[54] FORMING FABRIC FOR USE IN PRODUCING A HIGH BULK PAPER WEB

[75] Inventors: Melur K. Ramasubramanian, Appleton, Wis.; Charles A. Lee, Knoxville, Tenn.

[73] Assignee: James River Corporation, Richmond, Va.

[21] Appl. No.: 855,328

[22] Filed: Mar. 20, 1992

Related U.S. Application Data

[63] Continuation of Ser. No. 428,823, Oct. 30, 1989, Pat. No. 5,098,519.

[51] Int. Cl.[5] ..... D21F 1/10

[52] U.S. Cl. ..... 162/348; 162/903

[58] Field of Search ..... 162/903, 348, 202; 428/175

[56] References Cited

U.S. PATENT DOCUMENTS

| | | | |
|---|---|---|---|
| 3,301,746 | 1/1967 | Sanford et al. | 162/113 |
| 3,322,617 | 5/1967 | Osborne | 162/296 |
| 3,994,771 | 11/1976 | Morgan, Jr. et al. | 162/113 |
| 4,102,737 | 7/1978 | Morton | 162/113 |
| 4,191,609 | 3/1980 | Trokhan | 162/113 |
| 4,239,591 | 12/1980 | Blake | 162/109 |
| 4,440,597 | 4/1984 | Wells et al. | 162/111 |
| 4,529,480 | 7/1985 | Trokhan | 162/109 |
| 4,637,859 | 1/1987 | Trokhan | 162/109 |
| 4,741,941 | 5/1988 | Englebert et al. | 428/71 |
| 4,759,391 | 7/1988 | Waldvogel et al. | 139/383 A |
| 4,761,258 | 8/1988 | Enloe | 264/518 |
| 4,849,054 | 7/1989 | Klowak | 162/109 |
| 4,942,077 | 7/1990 | Wendt et al. | 428/152 |

*Primary Examiner*—W. Gary Jones
*Assistant Examiner*—Brenda Lamb
*Attorney, Agent, or Firm*—Luedeka, Hodges, Neely & Graham

[57] ABSTRACT

There is disclosed a novel woven multiplex forming fabric defining pockets in one surface thereof into which cellulosic fibers in an aqueous medium are flowed under conditions of flow and rate of water removal that establish high shear fluid flow and result in the orientation of fibers and/or fiber segments at an angle with respect to the plane of the forming fabric and their capture in the pockets and in the areas of the fabric adjacent the pockets.

5 Claims, 3 Drawing Sheets

FORMING FABRIC FOR USE IN PRODUCING A HIGH BULK PAPER WEB

This is a continuation of application Ser. No. 07/428.823, filed Oct. 30, 1989, now U.S. Pat. No. 5,098,519.

This invention relates to woven forming fabrics employed in papermaking methods. Specifically, it relates to woven multiplex forming fabrics which include two or more layers and which are useful in the production of a paper of high bulk and more specifically to a tissue or towel web having improved bulk and other characteristics.

In the papermaking art, bulking of paper, especially tissue or towel, has been attempted through means such as creping, embossing of various types including embossing rolls or impression of a wet web on a fourdrinier wire against a Yankee dryer, and similar mechanical or semi-mechanical treatment of the tissue web during or after its formation. These types of web treatments have been suggested for wet, partially dry and dry webs.

Heretofore in U.S. Pat. No. 3,322,617 it has been proposed to form a paper web having a simulated woven texture by depositing a slurry of papermaking fibers onto a screen configuration consisting of a fine mesh (i.e. 100 mesh) lower or base member which acts as a fiber accumulator and conveyor, and a superposed screen which is coarser in nature and which is said to tend to fashion or mold the product into the form or configuration desired. This patent teaches coarse screens having a mesh size of as few as 2 wires per inch up to about 14 mesh, the concept being to develop relatively large pattern elements in the paper web product which result from the pattern-masking-off of areas of the fine mesh wire through the use of coarse wires or other solid masks, such as round discs. The webs so produced are characterized by the fibers being oriented with their length dimensions generally parallel to the plane of the web, i.e., in the nature of a molding operation in which the fibers orient themselves in the plane of the molded product. This is a result in part of the relatively low rate of deposition of the furnish onto the screens and the relatively large sizes of the openings in the coarse screen. In this proposed technique the fine and coarse wires are independent of one another and are subject to shifting relative to one another, especially as they wrap the various rollers of the papermaking apparatus, with resultant disruption of the pattern or the interfiber bonds. Further, removal of the formed web from the two wires of this prior art technique can only be accomplished where the mesh size of the coarser wire is large, e.g. 2 to 14 mesh, without destruction of the web, due to the fibers "sticking" in and between the individual wires.

It has long been recognized in the papermaking art that papermaking fibers tend to lodge themselves in the mesh of forming fabrics with resultant disruption of the web when it is couched or otherwise removed from the forming fabric. As a consequence, heretofore, it has been taught that web formation, especially webs of the lower basis weights such as tissue or towel webs, occurs best where the conditions are such that there is minimum entrapment of the fibers in the interstices of the woven forming fabric. Thus, for example, it has been the practice heretofore in forming tissue-type webs to use fine mesh forming fabrics that present a relatively flat surface to the web-forming fibers to thereby reduce fiber entanglement with the fabric. After partial or complete formation of the web, these prior art webs are "bulked" by embossing, creping, etc. These bulking techniques tend to be costly and to disrupt the fiber-to-fiber bonds with resultant degradation of the strength properties of the resultant paper. In other certain prior art techniques for forming bulkier tissue or towel webs, special forming fabrics have been designed with smooth-walled openings that more readily release the web, e.g. U.S. Pat. No. 4,637,859. These techniques however suffer from higher costs and from disruption of the interfiber bonding and loss of web strength and/or bulk during the .course of web formation.

It has now been discovered that a web having enhanced bulk and absorbency characteristics, and whose bulk and absorbency are relatively permanently imparted to the web, can be manufactured through the means of depositing papermaking fibers from a suspension of such fibers in a flowable medium, e.g. an aqueous or foam medium, preferably including a distribution of fiber lengths, onto a multiplex forming fabric which includes a fine mesh layer and a coarser mesh layer, interwoven with the fine mesh layer, under conditions of high fluid shear furnish flow and dewatering that provide highly mobile, well dispersed fibers, segments of which are caused to be deposited into water-permeable pockets defined by the yarns of the coarser mesh layer. Initially deposited fiber segments lodge against the fine mesh layer which defines the bottom of each pocket and against the coarser yarns that define the lateral perimeter of each pocket to build up an initial layer of fibers and fiber segments on the fine mesh layer and around the perimeter of each pocket which acts to filter out further fibers flowing into the pocket. Further fibers flow into the pocket and substantially fill the same with fibers. The resultant web is characterized by a relatively large number of fiber-filled nubs that project from the plane of the web. Each such nub represents a pocket in the forming fabric, defined by the adjacent yarns of the woven coarse mesh layer of the forming fabric and bottomed by the fine mesh layer. The deposition of fibers is conditioned so that further fibers and fiber segments are deposited which develop a layer of fibers on the top of the individual yarns of the coarser mesh layer to develop a relatively smoother top surface on the web on the forming fabric and serve as lands between adjacent nubs, depending upon the weight of the web and the fabric design. Whereas the papermaking fibers are referred to herein as being suspended in an aqueous medium, it is understood that the fibers may be suspended in another liquid or flowable medium, e.g. foam.

In accordance with the present invention, the furnish is dewatered rapidly, that is, almost immediately upon the deposition of the furnish onto the multiplex fabric. This is accomplished in one embodiment through the use of a suction breast roll about which the fabric is entrained as the fabric is moved past the discharge of a headbox. In another embodiment, the furnish is discharged from the headbox onto an open breast roll under pressure. In a still further embodiment, the furnish is caused to flow under conditions of high fluid shear from a headbox into the nip between the wires of a twin wire papermaking machine. The present invention may employ a fourdrinier machine, and while the results obtained represent an improvement over the prior art, such improvement is less dramatic than that obtainable with breast roll machines. In either embodiment, the flow of furnish is sufficient to accommodate the relatively high furnish discharge volume required to supply the quantity of fibers necessary to produce the web of the present invention at fabric speeds in excess of 750 feet per minute (fpm), e.g., up to about 7500 fpm. The rate of withdrawal of water from the furnish on the fabric at the breast roll is established so as to increase the fiber consistency of the web to between about 2 to 4% by the time the web leaves the breast roll, for example. This manner of fiber deposition has been found to establish, very early in the web formation, good interfiber bonds within the web and preferred fiber orientation, particularly within the coarse layer pockets as will appear more fully hereinafter.

In the present invention, the rapid withdrawal of water from the slurry on the web generates substantial drag upon the fibers of the slurry to cause substantial ones of these fibers to become oriented with their length dimension generally parallel to the direction of flow of the water. The present invention provides for strong flow of the water through the thickness of the forming fabric, i.e. in a direction at an angle relative to the plane of the fabric. The fibers of the slurry thus are dragged by quite strong forces toward and into the pockets. As they are dragged, a substantial portion of their respective length dimensions become oriented in the direction of flow, i.e. at an angle to the plane of the forming fabric. Substantial numbers of the shorter fibers are captured in the pockets with their length dimensions also generally acutely angularly oriented with respect to the plane of the fabric, hence to the base plane of the resultant web. Especially where the longer fibers wrap the yarns of the coarse layer of the forming fabric, their end portions are caused to drape into the pockets so that such ends are oriented at an angle to the plane of the fabric. It will be recognized that this alignment of the fibers results in many fiber segments or fiber ends being somewhat "on end" and substantially parallel to one another within the pockets, hence within the nubs of the resulting web. Such fiber orientation is referred to herein as "fiber segment Z orientation". As will be further described hereinafter, the web of the present invention exhibits good resistance to collapse of the nubs when compressed in a direction normal to the base plane of the web, i.e. the Z direction, and excellent rates of absorptivity. While it is not known with certainty, it is believed that these desirable characteristics of the web are related to the described preferred orientation of the fibers within the nubs. For example, it is suggested that fiber segments that are generally Z-oriented and substantially parallel to each other in the nubs resist collapse of the nubs since the forces tending to collapse the nubs are directed against the aligned fiber segments in the Z-direction thereby exerting an axial compressive component against the fiber segments as opposed to being totally directed laterally against the sides of the fibers, and the fibers do not bend as readily. In general, the resistance of the fibers to bending under axial compression is about twice the resistance of the fibers to bending when the bending force is applied laterally to the length dimension of the fibers. The proximity of parallel fibers also is felt to enhance the "bundle" effect and also aid in resisting collapse of the nubs.

Further, it is postulated that the orientation of the fibers as described develops numerous relatively non-tortuous and relatively small capillaries within each nub that lead from the distal end of the nub inwardly toward the base plane of the web. Such capillaries are thought to at least partially contribute to the observed improved absorbency rates. And still further, in the embodiment where the web is dried while on the forming fabric, there is less bonding of the fibers in the nubs to one another, hence there is developed lower density and higher absorbency in the web.

Following the initial deposition of the fibers onto the fabric, the web may be further dewatered by conventional techniques such as the use of foils, drainage boxes, through-airflow, can dryers and the like. Suction after the initial web formation such as causes substantial deformation of the web or of the fibers in the web preferably is avoided inasmuch as such suction causes the fibers to "stick" to and in the forming fabric thereby making it difficult, if not impossible to later remove the web from the forming fabric, e.g. at a couch roll, without destroying the desired web formation. Most importantly, as the web is moved through the papermaking machine, at no time is the web subjected to inordinate mechanical working of the web greater than the normal working of the web that occurs as the web passes through the papermaking machine, e.g. through the suction pressure roll and Yankee dryer combination or through normal suction presses and standard can dryer systems. Consequently, the resultant web not only retains good strength, but it has been found that those portions of the web which were formed within the pockets of the coarse layer develop strong pronounced nubs that project from the plane of the web on one surface of the web and that these nubs are substantially filled with fibers that have not been materially disturbed subsequent to their formation. Such nubs have been found to impart a desirable bulkiness to the web and, as noted, to exhibit an unexpected resistance to collapse or destruction during subsequent use of the web as, for example, a towel or wipe product, and especially when wetted. Further, the fiber-filled nubs have been found to provide good reservoirs for absorption of liquids, exhibiting both enhanced absorptivity and rate of absorptivity.

It has been discovered further that the wet web formed by the present method can be removed from the forming fabric at fiber consistencies in the web of as low as about 20%. Bearing in mind the relatively low density of the present web, this discovery is indicative of the excellent web formation obtained by the present initial deposition of the fibers onto the forming fabric. Importantly, this ability to remove the very wet web, its nubs essentially intact, from the forming fabric provides the opportunity to transfer the web from the fabric to a dryer, e.g. a Yankee dryer. When the web is applied to the Yankee dryer with the nubs in contact with the dryer surface, it has been found that pressure applied to the web nubs by the pressure-suction roll develops greater pressure per unit area of web nub contact with the dryer surface, hence improved adhesion of the web to the dryer. This is due to the fact that essentially only the distal ends of the nubs are being pressed against the dryer and because of the resistance of the nubs to collapse, the pressure applied by the pressure suction roll is distributed essentially only to the web nubs. This feature is useful when it is desired to crepe the web as it leaves the Yankee dryer and thereby enhance the bulk and absorbency of the web. Alternatively, the wet web may be subjected to suction pressing to further enhance its tensile strength and densify the web without destructive mechanical working of the web.

In the disclosed web, the nubs further provide a large surface area on that surface of the web which bears the nubs. These nubs are closely spaced to one another, e.g. 100 to 500 nubs per square inch of web, so that they tend to collect liquid droplets between adjacent nubs thereby aiding in the initial pickup of liquids by the web and holding such droplets in position to be absorbed by the nubs.

Accordingly, it is an object of the present invention to provide a novel forming fabric for use in the production of a high bulk paper web. It is another object of the present invention to provide a multiplexforming fabric the use in the manufacture of a high bulk paper web.

Other objects and advantages of the present invention will be recognized from the description contained herein, including the drawings in which:

FIGS. 1A-1D are computer-developed representations of one embodiment of a multiplex forming fabric employed in the manufacture of the present web, FIG. 1A being a plan view of the coarser mesh layer of the fabric; FIG. 1B being a partial cross-section of the full fabric thickness taken generally along the line 1B—1B of FIG. 1A; FIG. 1C being a plan view of the fine mesh layer of the fabric; and FIG. 1D being a partial cross-sectional view of the full fabric thickness as viewed from the bottom of FIG. 1A;

FIGS. 2A-2D are computer-developed representations of another embodiment of a multiplex forming fabric employed in the manufacture of the present web, FIG. 2A being a plan view of the coarser mesh layer of the fabric; FIG. 2B being a partial cross-section taken generally along the line 2B—2B of FIG. 2A; FIG. 2C being a plan view of the fine mesh layer of the fabric; and FIG. 2D being a cross-sectional view of the full fabric thickness as viewed from the bottom of FIG. 2A.

Figure 5:
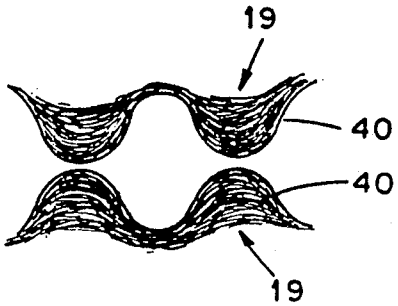
FIG. 5 is a representation of an embodiment of a portion of a papermaking machine employing a drying section for drying the web on the forming fabric.

With specific reference to the FIGURES, in accordance with one aspect of the present invention, a multiplex forming fabric 12 in accordance with the present invention is provided on a papermaking machine, papermaking fibers are dispersed in an aqueous medium to develop a furnish that is flowed onto the multiplex forming fabric 12, trained about a suction breast roll 14, from a headbox 16. From the headbox, the web 19 on the fabric 12 is trained about a roll 30. Thereafter, the web 19 is couched from the fabric as by a couch roll 32 about which there is trained a felt 34. The web on the felt is thereafter pressed onto a Yankee dryer 36 as by means of press rolls 38 and 40. In FIG. 5, there is depicted an embodiment in which the web 19 while still on the fabric 12 is conveyed through a drying section 26 and the dried web is collected in a roll 28. The fibers suitable for use in the present method may be of various types, for example 100% Douglas fir bleached softwood kraft, 100% bleached hardwood kraft, 70% bleached eucalyptus kraft and 30% softwood such as northern pine or spruce, or chemithermomechanical pulps alone or mixed with kraft pulps. Other fiber types suitable for the manufacture of tissue or towel webs may be employed as desired. As desired various additives such as wet strength additives, e.g. Kymene, may be included in the furnish. The fibers of the present furnish are only lightly refined, preferably such refining being of a nature which does not result in alteration of the basic nature of a substantial number of the fibers such as reduction in length, weakening of the fibers, etc. Conventional refiners operated in a relatively "open" mode for relatively short periods of time provide suitable refining of the fibers.

By way of example, furnish prepared from 100% Kraft softwood (Douglas fir) exhibited a Kaajani fiber length distribution of 3.17 mm (mass weighted average); 100% Kraft hardwood (Burgess) exhibited 1.49 mm; and a 70/30 mixture of these same softwood and hardwood pulps exhibited 2.03 mm. The total fiber counts of these same furnishes were 9764, 21934 and 35422, respectively. The average length of Douglas fir fibers is reported to be between about 3.3 to 3.5 mm which is one of the longest of the usual papermaking fibers.

The furnish may be adjusted by the addition of up to between about 10 and about 15% broke, so that the furnish as it leaves the headbox contains, for example, 15% broke and 85% of the 100% Douglas fir fibers In like manner, the furnish may comprise hardwood fibers, such as 100% Burgess fibers, or combinations of hardwood and softwood fibers. Still further, monocomponent or bicomponent synthetic, e.g. polymeric, fibers may be employed Employing the concepts disclosed herein, webs of basis weights between about 5 lbs/rm up to about 45 lbs/rm may be produced. The lighter weight webs are suitable for use as facial tissue or toilet tissue and the heavier weight webs are useful in towels and wipes.

One embodiment of a forming fabric 12 in accordance with the present invention for making lighter weight tissue is depicted in FIGS. 1A-1D and comprises a woven multiplex fabric including a first fine mesh layer 20 overlaid by a coarser mesh layer 22. The two layers are bound together as a unit by weaving one or more of the yarns of the fine mesh layer into the coarse mesh layer, as desired. The depicted weave pattern of the coarser layer 22 of the forming fabric 12 comprises a square weave pattern in which each of the cross machine direction and the machine direction yarns pass under and over every other yarn to define pockets 23 that are bounded at the bottom of the pocket by the fine mesh layer and at the sides of the pocket by the contiguous yarns 25, 26, 27 and 28, for example, of the coarser mesh layer. The adjacent coarser yarns further define lateral passageways through which a portion of the water from the slurry passes as it is withdrawn from the slurry. The coarser and fine yarns further define openings 21 between adjacent yarns that extend through the thickness of the wire for the flow of liquid therethrough. Another embodiment of a suitable forming fabric that is useful in producing tissue or towel webs is depicted in FIGS. 2A-2D and includes a complex weave which develops a fine mesh layer 30 overlaid by a coarser mesh layer 32 The yarns 35 of the coarse mesh layer define the opposite sides 31 and 39 of a plurality of pockets 37, with other sides 41 and 43 and the bottom of the pockets being established by several yarns 34. As described above, with reference to FIGS. 1A-1D, the adjacent yarns of the fabric depicted in FIGS. 2A-2D define lateral and through passageways for the flow of water from the slurry through the thickness of the fabric. It will be recognized from the FIGURES that the CD and MD yarns of either the fine mesh or the coarser mesh layer may be of different sizes and present in different numbers of each.

The preferred forming fabric, of the present invention, as noted, comprises two layers—namely, a fine mesh layer and a coarser mesh layer. The weave of each layer may vary from a square weave to a very complicated weave pattern. FIGS. 1 and 2 depict woven forming fabrics of very different characteristics. In each fabric, however, the fine mesh layer is designed to permit the flow of water therethrough, while not permitting the passage of fibers. In serving this function, the fine mesh layer commonly will include many yarns, usually oriented in the machine direction, which are of relatively small diameter and which are relatively closely spaced to one another. This construction provides many openings through the layer through which water, but not fibers, can escape. In the prior art, this fine mesh layer commonly was positioned on the top, i.e. fiber-receiving side of the forming fabric so that the fibers collected on the fine mesh layer in a smooth web. In the present invention, the fine mesh layer has overlaid thereupon and integrally woven therewith, a coarser mesh layer. This coarse mesh layer comprises that number and size of yarns which develops a desired number of pockets for the collection of fibers therein for the development of the nubs on that surface of the resultant web that is in contact with the forming fabric during web formation. In some of the more complicated forming fabrics it may be difficult to distinguish an absolute demarcation line between the fine mesh and coarser mesh layers of the forming fabric. This is because of the weave pattern which may involve considerable coursing of one or more yarns between the layers. Such yarns serve to bind the two layers together against relative movement therebetween and in some instances to aid in defining a portion of the perimeter of the pockets Thus, it will be recognized that the Examples given in this disclosure are to be considered representative and not limiting of the possible designs of forming fabrics. It will further be recognized that in a square weave, multiplying the number of cross direction yarns by the number of machine direction yarns will give the mesh of the fabric per square inch. For example, in a square weave fabric having 30 cross direction yarns per linear inch and 30 machine direction yarns per linear inch, the fabric has a mesh of 900. On the other hand, in the complex woven fabric depicted in FIG. 2, there are 88 machine direction yarns per linear inch of the fabric and 54 cross direction yarns per linear inch of the fabric. However, due to the complex weave pattern of this fabric, there are developed pockets which individually are approximately 0.038 inch wide in the cross machine direction and approximately about 0.068 inch wide in the machine direction. Therefore, there are approximately 416 pockets per square inch of the fabric.

In a preferred fabric for making tissue or towel webs the diameter of smallest individual yarns of the fine mesh layer may range between about 0.005 and 0.015 inch, and preferably between about 0.006 and 0.013 inch. In the coarse mesh layer the number of the individual yarns, their positioning within the layer, and their diameter affect the size of the pockets defined between adjacent yarns, including the depth of such pockets. Thus the diameter of the largest individual yarns in the coarse mesh layer may be between about 0.011 and 0.020 inch, and preferably is not less than about 0.012 inch. As noted in FIGS. 2A–2D, the coarse mesh yarns may be "stacked" to achieve deeper pockets while maintaining flexibility in the forming fabric. In a preferred wire, the individual yarns are polyester monofilaments, but other materials of construction may be used. Best release of the formed web from the fabric is obtained when the yarns are plastic monofilaments or stranded yarn coated to simulate a monofilamentary structure.

In the present forming fabric, it will be noted that the individual pockets, being defined by the yarns that weave in and out among themselves, are generally "cup shaped", i.e. they do not have sides that are oriented normal to the plane of the fabric. The pockets thus are not of uniform depth across their cross-sectional area but generally are deepest in their center portions. The number of pockets formed in a fabric may vary widely, depending upon the mesh and weave pattern of the coarser fabric, but basically the bottoms of the pockets are defined by the fine mesh layer. Thus, as noted, the mesh of the fine mesh layer must be chosen to effectively capture the fibers as the water is initially withdrawn from the slurry. This desired mesh may take the form of multiple cross-direction fine mesh yarns interwoven with multiple machine-direction yarns, or in other instances by capturing a plurality of MD yarns between a relatively few CD yarns, or vice versa. Pockets of non-uniform depth as described have been found to be beneficial in obtaining release of the wet web from the forming fabric with minimum sticking of the fibers in the fabric and therefore minimum disruption of the nub formations.

Importantly, in the present invention, the fine mesh layer 20 of the forming fabric is disposed in contact with the breast roll and the coarser layer 22 is outermost to receive the furnish from the headbox. In this manner, the pockets 23 (FIG. 1A) and 37 (FIG. 2A) of the coarser layer define the individual pockets for receiving the furnish as described herein.

In order to obtain the dispersion of fibers desired in the manufacture of the present web, the consistency of the furnish exiting the headbox is maintained between about 0.10% and about 0.55%, preferably between about 0.25% and 0.50%. Within this range of fiber concentrations, and under the state of high fluid shear furnish flow referred to herein, a high percentage of the fibers of the furnish are substantially individually suspended within the aqueous medium. Under the same conditions of flow, greater concentrations cause fibers to form into and move onto the forming fabric as entangled masses of fibers, i.e. networks. In order to form the desired web, it has been found to be important in obtaining uniformity of the fiber population within the web, that the fibers be in a high state of mobility at the time of their deposition on the fabric. The ultimate degree of mobility, i.e. dispersion, is achieved when each fiber behaves as an individual and not as a part of a network or floc. However, it is recognized that many fiber flocs exist, but desirably, their number, and especially their size, are kept small. Such provides a very uniform web while also developing the desired orientation and deposition of the fibers in the pockets. Deposition of the fibers and their compaction continues for a time determined by the operational parameters of the papermaking machine until the pockets become substantially filled with fibers and there is developed a substantial thickness of fibers on the top surface of the coarse mesh layer of the fabric and the desired compaction of the web.

Figure 1A:
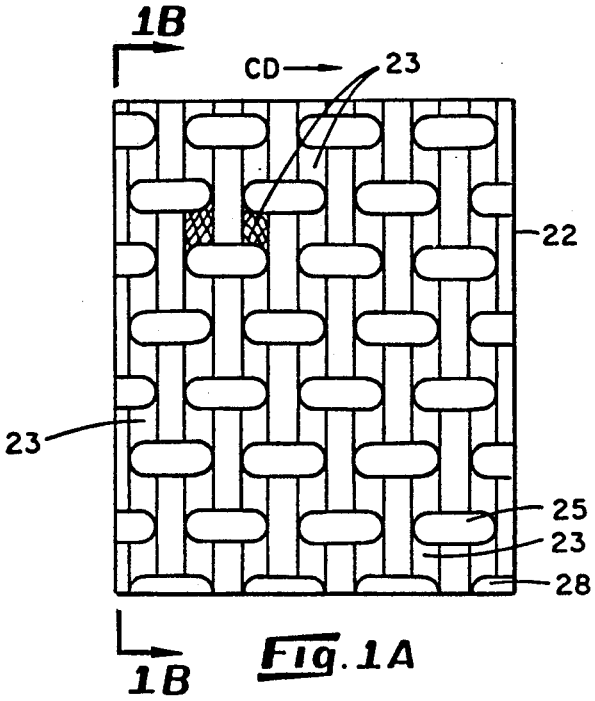
Figure 1B:
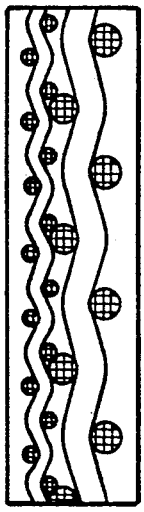
Figure 1C:
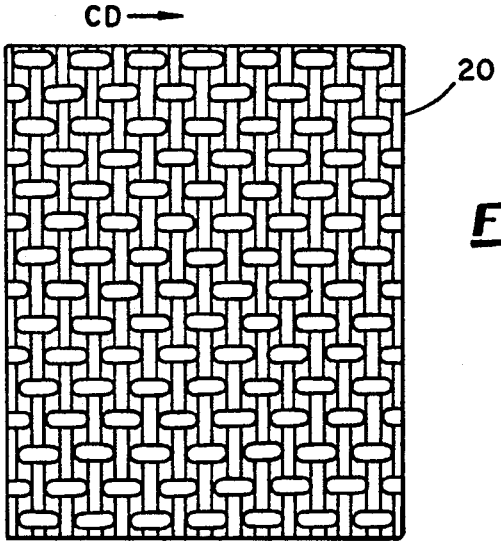
Figure 1D:
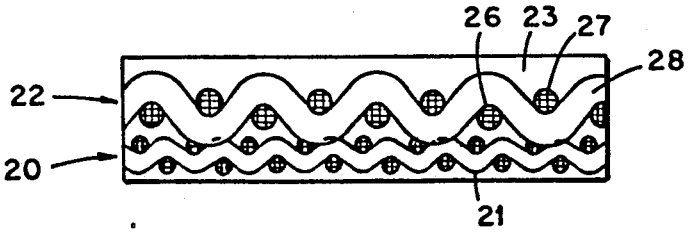
Figure 2A:
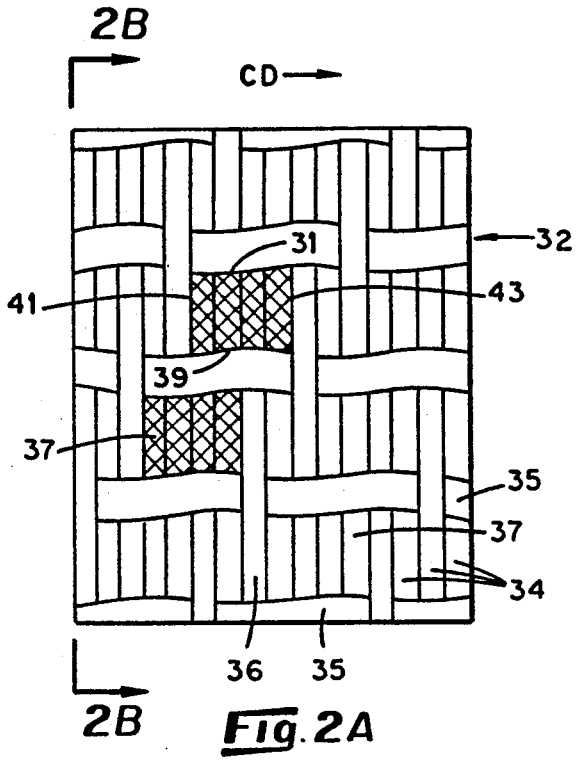
Figure 2B:
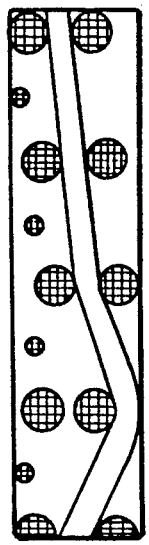
Figure 2C:
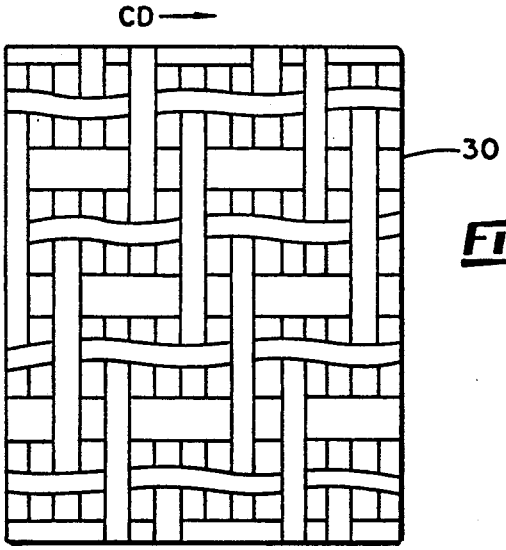
Figure 2D:
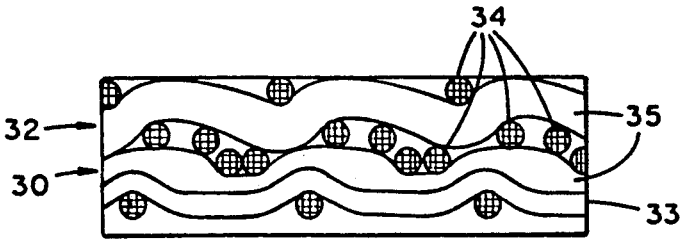
Figure 3:
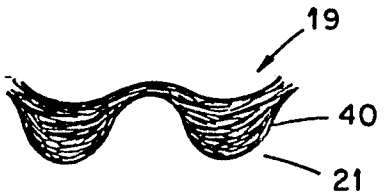
FIG. 3 is a schematic representation of one embodiment of a papermaking machine employing a forming fabric in accordance with the present invention and a series of suction boxes in the headbox region of the machine, for use in the manufacture of high bulk paper web.
Figure 4:
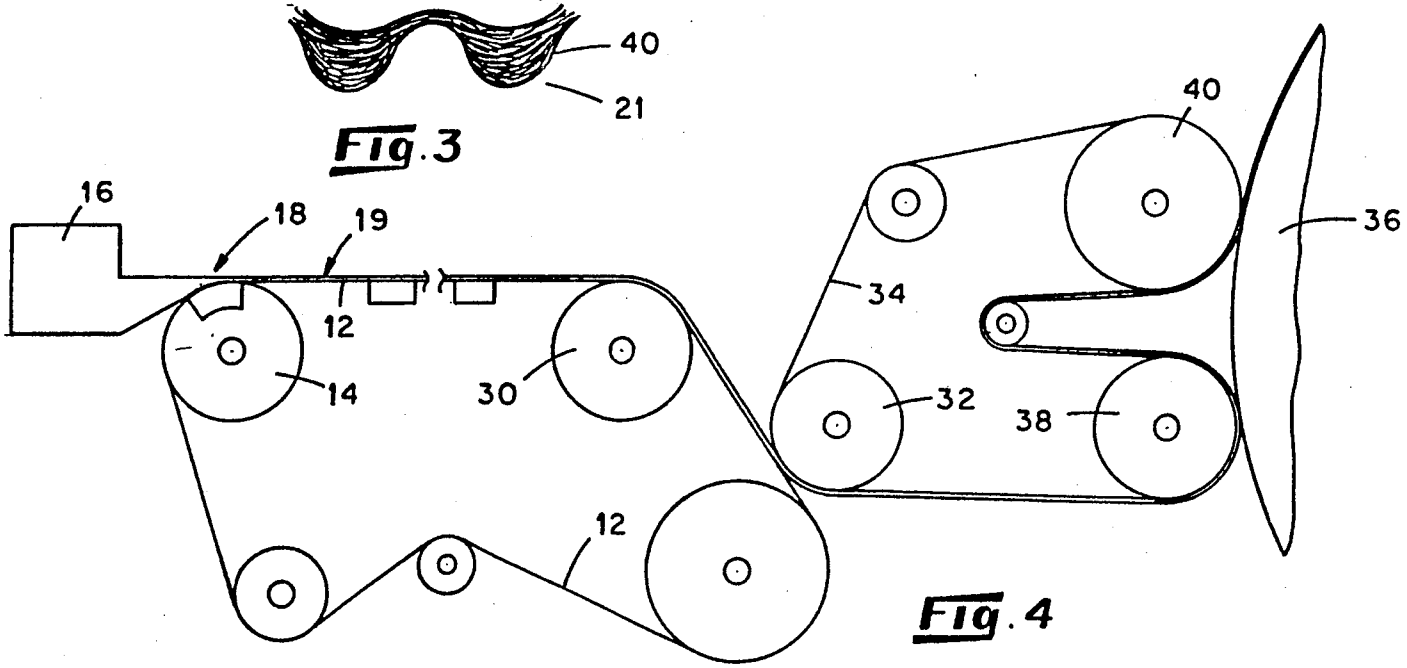
FIG. 4 is a fragmentary schematic representation of a cross-section through a portion of a high bulk web manufactured on a papermaking machine that is equipped with a multiplex forming fabric in accordance with the present invention.

Accordingly, in the present invention, the furnish is flowed onto, and the water flows through, the fabric at a velocity related to the fabric speed, e.g. 3600–7500 fpm, as the fabric, entrained about a breast roll 14, passes the discharge 18 of the headbox to form a web 19. In forming the present web, the fabric is moved at a linear forward speed of at least 750 fpm, and preferably between about 5000 and 7500 fpm. In one embodiment, about 8 linear inches of the forming fabric is disposed in effective engagement with the breast roll at any given time so that at a fiber concentration of 0.20% in the furnish which is suitable for making tissue in the basis weight range of about 9 pounds (per each 480 sheets measuring 24×36 inches), and assuming a forming fabric width of 29 inches and a headbox discharge opening of about 14 square inches, at a forming fabric speed of 5000 fpm, approximately 2300 gallons of furnish must be deposited on the fabric per minute while it is disposed beneath the discharge of the headbox. For 15 pound tissue approximately 3800 gallons per minute of furnish at 0.20% consistency is required. Sufficient water in the furnish should be drawn through the fabric at the breast roll, or in the headbox region as shown in FIG. 3, to develop a fiber consistency of about 2 to 4% in the web as it leaves the breast roll. Both these operating parameters, i.e. rate of furnish deposition on the fabric and the withdrawal of water at the breast roll, have been found to be important in developing the desired microturbulence, high shear and resultant fiber mobility that produces the web of the present invention.

The web formed on the forming fabric may be maintained on the fabric for further dewatering and drying as in a drying section 26. The dried web can then be removed from the fabric and collected in a roll 28. As noted hereinbefore, in one embodiment, the web is removed from the forming fabric at unexpectedly high water percentages, e.g. about 20% fiber by weight. In any event, it is preferred in forming the desired web, that the bonding of the fibers in the web which is established upon the initial deposition of the fibers onto the fabric, not be materially disturbed during the further dewatering and drying of the web. By this means, the initially developed preferred orientation of the fibers and their bonding is retained in the final web product.

As depicted in FIGS. 2 and 3, in one embodiment the web 19 of the present invention is bi-facial. That surface 21 of the web formed in the pockets 23 between the yarns of the coarse mesh layer comprises a plurality of nubs 40 that project out of the plane of the web on the bottom surface thereof. As noted above, each such nub represents a pocket in the coarse mesh layer of the fabric so that there are essentially as many nubs per square inch as there were pockets per square inch of the coarse mesh layer of the fabric on which the web was formed. In like manner, the diametral dimension, the height of each nub and the lateral spacing of the nubs is a function of the spacing between, the diameter of, and/or the number of the individual yarns of such coarse mesh layer as well as the weave of the fabric.

EXAMPLE I

Employing the present method, tissue webs having an overall thickness of up to about 0.02 inch have been produced. In one specific example, tissue handsheets were produced using a Kraft furnish comprising 100% Douglas fir bleached softwood. This furnish was refined lightly in a Valley Beater to a CSF of 469. This furnish was adjusted to a fiber consistency of 0.1% and a pH of 7.5. A British handsheet former was fitted with a forming fabric as described hereinafter and filled with 7.0 liters of water at a pH of 7.5. 0.449 g of fiber from the 0.1% furnish were added to the former. This quantity of fibers yields a sheet having a weight of 14.5 lb/rm. After mixing, the water was drained from the former to form a fiber mat on the forming fabric. While the mat was on the fabric, a vacuum was drawn through the mat and fabric to further dewater the mat. The initial vacuum was 20–26 inches of water which reduced to 3–5 inches after about one second. This latter vacuum was continued for 2 minutes.

The fabric with the mat thereon was removed from the former and placed on a porous plate in a Buchner funnel. Four passes of vacuum were drawn on the mat through the forming fabric, with each pass of one second duration at 20–26 inches of water. The position of the mat was rotated a quarter turn for each pass to obtain uniform dewatering.

The dewatered mat, together with the forming fabric, was placed in an oven at 85° C. for 20 minutes to dry the sheet. After cooling, the mat was removed from the fabric and tested.

In this Example, the forming fabric was of a design (designated Fl) as depicted in FIGS. 2A–2D comprises integrally woven fine mesh and coarse mesh layers. Because of the interlocking nature of certain of the yarns of this fabric, its depiction in two dimension as in the FIGURES prevents a true planar separation of the fabric into the fine and coarse layers. In these FIGURES, it will be recognized however that the fabric includes cross-direction (CD) yarns 35 having a diameter of 0.0197 inch. In the depicted fabric there are two such yarns essentially stacked atop the other, and separated at intervals by machine direction (MD) yarns 34 each of 0.0122 inch diameter. In the CD there also are provided a number of 0.0091 inch diameter yarns 33 which extend in the CD and MD to serve, among other things, to interlock the fine and coarse mesh layers. In the fabric depicted in FIGS. 2A–2D, there are 54 openings per linear inch in the CD and 88 openings per linear inch in the MD, about 416 pockets per square inch of fabric, each pocket being approximately 0.038 inch in the MD and approximately 0.068 inch in the CD and of a varying depth up to a maximum of about 0.05 inch. As noted, because the pockets are defined by yarns of circular cross-section, each pocket is generally "cup-shaped" and in the embodiment of FIGS. 2A–2D each pocket has a somewhat oblong and/or trapezoidal geometry that results in rows of nubs in the web product that appear to extend diagonally to the MD of the product. Also as noted, the pockets 37 open outwardly of the fabric to receive the fiber slurry from the headbox.

Further handsheets were made using the same procedure as set forth above but using bleached hardwood kraft containing a minor percentage (approximately 10%) of softwood having a CSF of 614.

Control handsheets were made using the softwood and hardwood described above and a forming fabric of 86×100 mesh woven in a 1, 4 broken twill weave (designated F2). This fabric had an air permeability of 675 CFM. Its machine direction yarns were 0.0065 inch in diameter and its cross direction yarns were 0.006 inch in diameter.

The results of the testing of these handsheets are given in Tables I-A and I-D.

EXAMPLE II

Handsheets were produced as in Example I but employing a multilayered fabric having 72 warp yarns and 86 shute yarns, each of 0.0067 inch diameter, in the fine mesh layer, and 36 warp yarns of 0.0106 inch diameter, and 43 shute yarns of 0.0118 inch diameter per square inch of its coarser mesh layer (designated F3). This fabric had an air permeability of 350 CFM. The results of the testing of these handsheets are given in Tables I-A and I-D.

EXAMPLE III

Using the same procedure as in Example I, handsheets were made using a forming fabric (designated F4) including a fine mesh layer having a fine mesh weave of 77×77, warp yarns having a diameter of 0.0067 inch and shute yarns having a diameter of 0.006 inch. The coarser mesh layer had a 39×38 weave made up of warp yarns of 0.013 inch diameter and shute yarns of 0.0118 inch diameter. Those warp yarns which were employed to connect the two layers were of 0.008 inch diameter. The fabric had an air permeability of 430 CFM. Tables I-A and I-D present the test data for these handsheets.

EXAMPLE IV

Further handsheets were made using the procedure of Example I but using a fabric (designated F5) including a fine mesh layer of a 78×70 weave, and warp and shute yarns each being of 0.006 inch diameter. The coarser mesh layer had a 39×35 weave, the warp yarns having a diameter of 0.0118 and the shute yarns having a diameter of 0.0110 inch. The air permeability of the fabric was between 500 and 540 CFM. Results from testing these handsheets are presented in Tables I-A and I-D.

TABLE I-A

| | Control (Fabric F2) | | | Repulped | Fabric F1 | | | Repulped | Fabric F3 | | |
|---|---|---|---|---|---|---|---|---|---|---|---|
| | Softwood | Hardwood | 70/30[1] | Tissue | Softwood | Hardwood | 70/30 | Tissue | Softwood | Hardwood | 70/3 |
| Tensile | | | | | | | | | | | |
| Young's Modulus (Kg/mm$^2$) | 30.18 | 7.199 | 15.8 | 7.26 | 13.26 | 0.357 | 1.083 | 0.2165 | 22.93 | 1.104 | 3.0 |
| Yield Stress (Kg/mm$^2$) | 0.347 | 0.037 | | | 0.157 | 0.007 | | | 0.253 | 0.016 | |
| Yield Strain (%) | 1.99 | 0.601 | | | 2.35 | 2.242 | | | 2.12 | 2.458 | |
| Max. Load (Kg) | 1.818 | 0.1766 | 0.651 | 0.4022 | 1.41 | 0.0785 | 0.2922 | 0.1322 | 1.753 | 0.1278 | 0.5 |
| Breaking Strength (Kg/mm$^2$) | 0.245 | 0.037 | 0.116 | 0.0742 | 0.111 | 0.007 | 0.0241 | 0.0095 | 0.175 | 0.016 | 0.5 |
| Total Elong. (%) | 2.5 | 0.61 | 1.739 | 1.843 | 2.7 | 2.3 | 2.974 | 5.522 | 2.9 | 2.5 | 2.7 |
| Energy to Break (Kg/mm$^2$) | 2.72 | 0.065 | 0.5472 | 0.4999 | 2.59 | 0.128 | 0.5547 | 0.4644 | 2.84 | 0.241 | 3 |
| Breaking Length (Km) | 3.07 | 0.3057 | 1.132 | 0.6933 | 2.39 | 0.1307 | 0.5026 | 0.2274 | 2.29 | 0.216 | 0.8 |

[1]70% hardwood and 30% softwood
[2]Single-ply bathroom tissue repulped

TABLE I-B

| | Control (Fabric F2) | | | Fabric F4 | | | Fabric F5 | | |
|---|---|---|---|---|---|---|---|---|---|
| | Softwood | Hardwood | 70/30[1] | Softwood | Hardwood | 70/30 | Softwood | Hardwood | 70/30 |
| Tensile | | | | | | | | | |
| Young's Modulus (Kg/mm$^2$) | 30.18 | 7.199 | | 22.13 | 1.620 | 3.58 | 26.26 | 5.279 | 10.42 |
| Yield Stress (Kg/mm$^2$) | 0.347 | 0.037 | | 0.276 | 0.022 | | 0.318 | 0.028 | |
| Yield Strain (%) | 1.99 | 0.601 | | 2.44 | 1.757 | | 2.38 | 0.591 | |
| Max. Load (Kg) | 1.818 | 0.1766 | 0.651 | 1.672 | 0.1517 | 0.5055 | 1.800 | 0.1990 | 0.5502 |
| Breaking Strength (Kg/mm$^2$) | 0.245 | 0.037 | 0.116 | 0.022 | 0.021 | 0.0617 | 0.140 | 0.028 | 0.1795 |
| Total Elong. (%) | 2.5 | 0.61 | 1.239 | 4.8 | 1.8 | 2.563 | 3.08 | 0.62 | 1.354 |
| Energy to Break (Kg/mm$^2$) | 2.72 | 0.065 | 0.5472 | 4.24 | 0.165 | 0.7922 | 3.43 | 0.066 | 0.5089 |
| Breaking Length (Km) | 3.07 | 0.3057 | 1.132 | 2.72 | 0.2460 | 0.8578 | 2.98 | 0.3230 | 0.9161 |

[1]70% hardwood and 30% softwood

TABLE I-C

| | Control | | | Repulped | Fabric F1 | | | Repulped | Fabric F3 | | |
|---|---|---|---|---|---|---|---|---|---|---|---|
| | Softwood | Hardwood | 70/30[3] | Tissue[4] | Softwood | Hardwood | 70/30 | Pulp | Softwood | Hardwood | 70/30 |
| Basis Weight (lb/rm) | 14.3 | 13.96 | 13.45 | 13.56 | 14.57 | 14.57 | 13.60 | 13.60 | 14.88 | 14.30 | 13.82 |
| Caliper (inch) | 0.0083[1] | 0.0075[1] | 0.0067[2] | | 0.0140[1] | 0.02[1] | 0.0183[2] | | 0.0114[1] | 0.0130[1] | 0.0125[2] |
| Apparent Bulk (cc/g) | 9.04 | 8.36 | 7.17 | | 15.16 | 21.48 | 20.70 | | 11.96 | 14.20 | 13.30 |
| Dry Resiliency Test | | | | | | | | | | | |
| % Compression | 44.12 | 46.82 | | | 35.14 | 48.02 | | | 39.52 | 48.84 | |
| % Resilience | 45.74 | 45.74 | | | 26.66 | 38.54 | | | 32.98 | 49.64 | |

TABLE I-C-continued

| | Control (Fabric F2) | | | Repulped | Fabric F1 | | | Repulped | Fabric F3 | | |
|---|---|---|---|---|---|---|---|---|---|---|---|
| | Softwood | Hardwood | 70/30[3] | Tissue[4] | Softwood | Hardwood | 70/30 | Pulp | Softwood | Hardwood | 70/30 |
| % Irreversible Collapse | 18.6 | 22.6 | | | 18.0 | 29.6 | | | 19.6 | 23.0 | |
| Absorbency | | | | | | | | | | | |
| Max. Abs. Absorbency (g/g) | 4.94 | 5.27 | 5.69 | 5.76 | 5.73 | 6.86 | 7.02 | 8.35 | 5.42 | 5.74 | 6.09 |
| Max. Retention (g/g) | 4.59 | 4.85 | 5.00 | 4.89 | 4.07 | 5.20 | 4.81 | 5.02 | 4.26 | 5.03 | 4.86 |
| Absorbency ($g/m^2$) | 112 | 117 | 128.8 | 131.56 | 135 | 157 | 160.7 | 190.7 | 125 | 126 | 141.7 |
| Absorbency w/load (g/g) | 3.55 | 3.66 | 4.12 | 4.37 | 3.54 | 3.99 | 4.06 | 5.38 | 3.51 | 3.68 | 3.92 |
| Absorbency w/o load (g/g) | 4.33 | 4.76 | 5.18 | 5.11 | 4.57 | 5.42 | 5.50 | 6.20 | 4.57 | 5.42 | 5.27 |

[1]In-house instrument using 2.36" diameter foot at 0.0704 psi
[2]TMI standard instrument using 2" diameter foot at 0.3838 psi
[3]70% hardwood and 30% softwood by weight
[4]Single-ply bathroom tissue repulped

TABLE I-D

| | Control (Fabric F2) | | | Fabric F4 | | | Fabric F5 | | |
|---|---|---|---|---|---|---|---|---|---|
| | Softwood | Hardwood | 70/30[3] | Softwood | Hardwood | 70/30 | Softwood | Hardwood | 70/30 |
| Basis Weight (lb.rm) | 14.3 | 13.96 | 13.45 | 14.88 | 14.88 | 13.78 | 14.57 | 14.88 | N.D. |
| Caliper (inch) | 0.0083[1] | 0.0075[1] | 0.0067[2] | 0.0110[1] | 0.0118[1] | 0.0098[2] | 0.0091[1] | 0.0091[1] | 0.0087[2] |
| Apparent Bulk (cc/g) | 9.04 | 8.36 | 7.17 | 11.56 | 12.37 | 12.43 | 9.69 | 12.37 | 9.35 |
| Dry Resiliency Test | | | | | | | | | |
| % Compression | 44.12 | 46.82 | | 33.68 | 50.04 | | | 32.78 | 37.20 |
| % Resilience | 45.74 | 45.74 | | 26.34 | 44.70 | | | 23.33 | 33.8 |
| % Irreversible Collapse | 18.6 | 22.6 | | 16.4 | 27.8 | | | 17.0 | 15.8 |
| Absorbency | | | | | | | | | |
| Max Abs. Absorbency (g/g) | 4.94 | 5.27 | 5.69 | 5.44 | 6.07 | 6.02 | 5.04 | 5.35 | |
| Max. Retention (g/g) | 4.59 | 4.85 | 5.00 | 4.27 | 5.21 | 4.81 | 4.46 | 4.92 | |
| Absorbency ($g/m^2$) | 112 | 117 | 128.8 | 127 | 140 | 139.7 | 117 | 119 | |
| Absorbency w/load (g/g) | 3.55 | 3.66 | 4.12 | 3.50 | 3.98 | 3.90 | 3.35 | 3.55 | |
| Absorbency w/o load (g/g) | 4.33 | 4.76 | 5.18 | 4.46 | 5.31 | 5.28 | 4.29 | 4.78 | |

[1]In-house instrument using 2.36" diameter foot at 0.0704 psi
[2]TMI standard instrument using 2" diameter foot at 0.3838 psi
[3]70% hardwood and 30% softwood by weight
[4]Single-ply bathroom tissue repulped
N.D. — not determined Analysis of the data of Table I reveals that forming fabric made in accordance with the present invention provide a tissue web that is markedly bulkier than the control, i.e. about 40% improvement in apparent bulk for softwood pulps and about 61% improvement for hardwood pulps, and has a higher absorbency. Notably, the absorbency of the present webs is enhanced by amounts ranging from about 9% to 31%. The strength properties of the web were acceptable, but if desired, enhancement of the web strength may be accomplished employing conventional strength additives. The web exhibited excellent hand and drape, such properties being important in most applications of tissue and towel webs. Further, the webs exhibited good resistance to irreversible collapse indicating stability of the nubs and making the web especially useful as a wipe, e.g. facial tissue or towel.

Importantly, the excellent bulk of the present web was obtained without such prior art techniques as creping, embossing, impressing the wire pattern into the web during drying, etc.

Whereas the greatest enhancement of bulk and certain other properties was achieved using forming fabric F1, it is noted that other of the fabrics produced webs having enhanced bulk, but to a lesser extent.

In the fibers of the various cellulosic materials employed in the present invention, the average length of the fibers ranges between about 0.0394 inch to about 0.1576 inch in length. It will be noted that in accordance with the present invention, the pockets defined in the forming fabric employed in forming the web of the present invention each has cross-sectional dimensions that approximate or are smaller than the average length of the fibers of the furnish. Thus, it will be immediately recognized that the pockets are filled with segments of the fibers as opposed to entire fibers, in the majority. Through the use of the high fluid shear forces developed in depositing the fibers onto the forming fabric as described hereinbefore, the segments of the fibers are "driven" into the pockets with the axial dimension of the individual fibers being generally aligned acutely angularly with respect to the plane of the fabric, hence with the base plane of the resulting web. Whereas it is not known with certainty, it is believed that because portions of many of the fibers remain outside a pocket and/or opposite ends of individual fibers reside in adjacent pockets, there is reduced entanglement of fibers with the finer yarns of the fine mesh layer of the forming fabric. As a consequence, the web is readily removed from the wire without material disruption of the fibers of the web. As noted hereinbefore, it has been found that a web containing as much as about 80% water can be successfully removed from the forming fabric and directed onto a felt or otherwise moved to a drying operation. It will be immediately recognized that this property of the present web, considering its low basis weight, has not been possible heretofore in the prior art.

Using forming fabrics in accordance with the present invention provides for the production of webs of equal or improved bulk, absorbency, etc., as prior art webs, but employing fewer fibers per unit area of the web, if desired.

The rate of water absorbency of various webs made in accordance with the present invention were determined. These rate are given in Table II.

TABLE II

| Fabric Type | Wicking Rate: $g/g/t^{\frac{1}{2}}$ Furnish | Slope or Rate |
|---|---|---|
| F1 | 100% Softwood | .242 |
| F2 | 100% Softwood | .244 |
| F1 | 100% Hardwood | .968 |
| F2 | 100% Hardwood | .626 |

In Table II, the higher slope value indicates faster wicking. Whereas webs prepared from 100% softwood did not show significantly different absorbency rates relative to the control, the 100% hardwood web showed significantly faster wicking rates, all as compared to webs formed on a single layer wire (Fabric F2).

We claim

1. In a papermaking machine for the manufacture of a paper web having a basis weight of between about 5 and about 45 lb./3000 $ft^2$ from a pulp of cellulosic fibers suspended in a flowable medium, employing a forming fabric onto one surface of which said pulp is deposited and liquid is withdrawn from said pulp through the thickness of said forming fabric to cause said fibers to be captured as a web on said forming fabric, said web exhibiting a plurality of nubs projecting from one surface thereof and having enhanced bulk, the improvement comprising a forming fabric disposed on said papermaking machine for receipt of said pulp thereon, said forming fabric including a first plurality of warp yarns woven with a first plurality of shute yarns to define a first layer of said woven yarns having a mesh size which is sufficiently small as to prevent the passage of a material quantity of said cellulosic fibers through the thickness thereof in the coarse of the withdrawal of said liquid medium from said pulp on said forming fabric, and a second plurality of warp yarns woven with a second plurality of shute yarns to define a second layer of said woven yarns that is disposed in overlying relationship to said first layer and which receives said pulp thereon, said first and second layers being united by means of one or more yarns being common to said first and second layers, said second warp and shute yarns being of materially larger individual diameters than said first warp and shute yarns, said second warp and shute yarns being of materially larger individual diameters than said first warp and shute yarns, said second warp and shute yarns defining the perimetral dimensions of a plurality of pockets within said second layer, the bottoms of said pockets being defined by said first layer, each of said pockets being of a depth and of a lateral dimension that are each less than the average length of said cellulosic fibers of said pulp whereby when said pulp is deposited on said forming fabric and at least substantial portions of said liquid in said pulp has been withdrawn from said pulp through the thickness of said forming fabric less than a majority of individual ones of said fibers are disposed in each of said pockets having a portion of the length of individual said fibers which is not disposed in each of said pockets overlaying a yarn which defines the perimetral dimension of each of said pockets, and insufficient numbers of or portions of said fibers are entangled with said yarns of said forming fabric to cause said web to be nonreleasable from said forming fabric at a web consistency of about 20%.

2. The forming fabric of claim 1 wherein under conditions of pulp flow wherein a pulp at between about 0.1% and 0.05% fiber content by weight in an aqueous medium is deposited onto said forming fabric, the mesh of said forming fabric is sufficient to permit the withdrawal from said pulp in about the first eight inches of travel of the forming downstream of the point of deposition of the pulp onto the forming fabric, an amount of aqueous medium sufficient to increase the fiber content of the pulp on the forming fabric to at least about 2% by weight.

3. The forming fabric of claim 1 wherein each of said pockets defined in said forming fabric has a maximum diametral dimension of less than about 4 mm.

4. The forming fabric of claim 1 wherein said forming fabric defines on one surface thereof between about 100 and 500 of said pockets per square inch of said forming fabric.

5. The forming fabric of claim 4 wherein said forming fabric defines on one surface thereof at least about 100 of said pockets per square inch of said forming fabric.

* * * * *

UNITED STATES PATENT AND TRADEMARK OFFICE

CERTIFICATE OF CORRECTION

PATENT NO. :5,211,815

DATED :May 18, 1993

INVENTOR(S) :Melur K. Ramasubramanian and Charles A. Lee

It is certified that error appears in the above-identified patent and that said Letters Patent is hereby corrected as shown below:

Column 5, line 10, delete "multiplexforming" and insert -- multiplex forming -- therefor.

In Column 5, between lines 33 and 34, insert -- FIG. 3 is a fragmentary schematic representation of a cross-section through a portion of a high bulk web manufactured in accordance with the present invention; --

In Column 5, at line 34, delete "3" and substitute -- 4 -- therefor.

In Column 5, at line 39, following "web", delete the period and insert -- ; and -- therefor.

In Column 5, at line 40, delete "4" and substitute -- 5 -- therefor.

In Column 5, at lines 41-44, delete "through a portion of a high bulk web manufactured on a papermaking machine that is equipped with a multiplex forming fabric in accordance with the present invention; and" and substitute -- of a composite web formed by a pair of webs in accordance with the present invention, overlaid with their respective nub-bearing surfaces facing one another. -- therefor.

In Column 5, delete lines 45-48.

UNITED STATES PATENT AND TRADEMARK OFFICE

CERTIFICATE OF CORRECTION

PATENT NO. :5,211,815

DATED :May 18, 1993

INVENTOR(S) :Melur K. Ramasubramanian and Charles A. Lee

It is certified that error appears in the above-identified patent and that said Letters Patent is hereby corrected as shown below:

Column 6, lines 26, after "fibers" insert -- . -- therefor.

Column 6, lines 62, after "32" insert -- . -- therefor.

Column 7, line 6, after "fabric" delete -- , -- therefor.

Column 7, line 40, after "pockets" insert -- . -- therefor.

Table 1-A, in the "Repulped Tissue" columns, in the heading, delete "Tissue" and insert -- Tissue$^2$ -- therefor.

Signed and Sealed this

Twelfth Day of July, 1994

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,211,815

DATED : May 18, 1993

INVENTOR(S) : Melur K. Ramasubramanian, et al

It is certified that error appears in the above-indentified patent and that said Letters Patent is hereby corrected as shown below:

Column 12,

Table I-A, in the "Fabric F3" column group, in the "70/3" column, and in the "Energy to Break" line, delete "3" and insert --0.8-- therefor.

Signed and Sealed this

Eighth Day of November, 1994

*Attest:*

*Attesting Officer*

BRUCE LEHMAN

*Commissioner of Patents and Trademarks*